US007748970B2

(12) United States Patent
Park

(10) Patent No.: US 7,748,970 B2
(45) Date of Patent: Jul. 6, 2010

(54) VACUUM PUMP HAVING FLUID PORT AND EXHAUST SYSTEM

(75) Inventor: Tea-Jin Park, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 327 days.

(21) Appl. No.: 11/864,145

(22) Filed: Sep. 28, 2007

(65) Prior Publication Data

US 2008/0118383 A1 May 22, 2008

(30) Foreign Application Priority Data

Nov. 17, 2006 (KR) ..... 10-2006-0113994

(51) Int. Cl.
*F01C 1/18* (2006.01)

(52) U.S. Cl. ..... 418/205; 418/5; 418/7; 418/9; 418/188

(58) Field of Classification Search ..... 418/5, 418/7, 9, 205, 188
See application file for complete search history.

(56) References Cited

U.S. PATENT DOCUMENTS 2,097,881 A * 11/1937 Hopkins ..... 418/183
4,789,314 A * 12/1988 Higuchi et al. ..... 418/9
5,173,041 A 12/1992 Niimura et al.
5,271,364 A * 12/1993 Snyder ..... 418/188
5,356,275 A * 10/1994 Brenner et al. ..... 418/9

FOREIGN PATENT DOCUMENTS

| | | |
|---|---|---|
| JP | 57-70985 | 5/1982 |
| JP | 8-83773 | 3/1996 |
| JP | 09-287581 | 11/1997 |
| JP | 10-299676 | 11/1998 |
| KR | 10-2005-0013016 | * 2/2005 |

OTHER PUBLICATIONS

English language abstract of Japanese Publication No. 57-70985.
English language abstract of Japanese Publication No. 09-287581.
English language abstract of Japanese Publication No. 10-299676.
English language abstract of Korean Publication No. 10-2005-0013016.

* cited by examiner

*Primary Examiner*—Thomas E. Denion
*Assistant Examiner*—Mary A Davis
(74) *Attorney, Agent, or Firm*—Volentine & Whitt, PLLC

(57) ABSTRACT

In an embodiment, a vacuum pump is capable of preventing adhesion of by-products to its surfaces. The vacuum pump includes a stator. The stator includes a cylinder wall and a pair of diaphragms disposed at opposite ends of the stator. A rotary shaft passes through the diaphragms, and a lobe is attached to the rotary shaft in the stator. The lobe may include a fluid port, and the fluid port may be disposed in sidewalls of the lobe to face the diaphragms. The rotary shaft may include a fluid supply path in communication with the fluid port.

19 Claims, 9 Drawing Sheets

VACUUM PUMP HAVING FLUID PORT AND EXHAUST SYSTEM

CROSS-REFERENCE TO RELATED APPLICATION

This application claims the benefit of Korean Patent Application No. 2006-0113994, filed Nov. 17, 2006, the disclosure of which is hereby incorporated herein by reference in its entirety.

BACKGROUND

1. Field of the Invention

The present invention relates to a vacuum pump, and more particularly, to a vacuum pump having a fluid pump, and an exhaust system.

2. Description of the Related Art

A process chamber for manufacturing a semiconductor device or a flat panel display, for example, uses various chemicals such as a process gas. By-products and residual gases generated in the process chamber may be transmitted to a scrubber using a gas discharge apparatus such as a vacuum pump. The scrubber cleans and separates the by-products and the residual gases before discharging them.

The vacuum pump includes a stator and a rotor. The stator includes a suction port and a discharge port. The rotor is disposed in a pump chamber of the stator. Depending on the shape of the rotor, the vacuum pump may be classified as a roots type, a screw type, or a claw type pump.

FIG. 1 is a partial perspective view of a conventional roots pump that includes a rotary shaft 1, a pair of lobes 12, and a first diaphragm 15. The lobes 12 and the rotary shaft 11 constitute a rotor 13. A second diaphragm (not shown) may be disposed opposite to the first diaphragm 15, on top of the rotor 13, for example. A cylinder wall (not shown) may be disposed to surround a pump chamber 17 between the first diaphragm 15 and the second diaphragm so that the rotor 13 is disposed in the pump chamber 17. The cylinder wall includes a suction port and a discharge port. The cylinder wall, the first diaphragm 15, and the second diaphragm constitute the stator.

The rotary shaft 11 passes through the first diaphragm 15 and the second diaphragm. The rotary shaft 11 includes the pair of lobes 12 attached opposite to each other. Two rotors 13 may be disposed in the pump chamber 17 and mesh with each other.

As the rotors 13 rotate they suck a gas from the suction port into the pump chamber 17, and discharge the sucked gas through the discharge port. The suction port may be connected to a process chamber, and the discharge port may be connected to a scrubber. In summary, by-products are sucked from the process chamber into the pump chamber 17 through the suction port formed in the cylinder wall, and discharged from the pump chamber 17 to the scrubber through the discharge port.

Problems may arise if, while passing through the pump chamber 17, the by-products solidify to generate by-product masses 19. The by-product masses 19 may stick to surfaces in the pump chamber 17. For example, the by-product masses 19 stuck between the lobes 12 and the first diaphragm 15 or the second diaphragm may interfere with the rotation of the rotors 13. Eventually, the by-product masses 19 may cause a malfunction of the roots pump, thus requiring earlier maintenance.

Heating the stator is one method of reducing problems caused by sticky by-product masses 19. This method requires a stator formed of a material having a high thermal transfer efficiency. The method also requires an additional apparatus, and energy consumption, for heating the stator.

Meanwhile, another method of removing by-products and lengthening the maintenance cycle of a pump is disclosed in U.S. Pat. No. 5,173,041, entitled "Multistage vacuum pump with interstage solid material collector and cooling coils", issued to Niimura, et al. According to Niimura, et al., a serial multistage roots pump is provided. A solid material collector having a cooling device is mounted at one side of the roots pump.

A method for removing by-product masses 19 without adding complexity to the manufacturing apparatus or increasing the required energy consumption is desired.

SUMMARY OF EMBODIMENTS

An embodiment includes a vacuum pump capable of preventing by-products from sticking to its surfaces. Another embodiment includes an exhaust system employing such a vacuum pump.

In a vacuum pump embodiment, the vacuum pump may include a stator. The stator may include a cylindrical wall with a diaphragm disposed at each end. A rotary shaft passing through the diaphragms may include a lobe attached to the shaft within the stator. The lobe includes a fluid port.

In some embodiments the fluid port may be disposed at sidewalls of the lobe opposite to and facing one or both of the diaphragms. The rotary shaft may include a fluid supply path in communication with the fluid port, and the fluid supply path may be disposed to pass through the rotary shaft.

In other embodiments, the rotary shaft may be connected to a fluid feeder. The fluid feeder may supply an inert gas or a cleaning solution into the fluid port through the fluid supply path.

In still other embodiments, the cylinder wall may include a suction port and a discharge port.

In yet other embodiments, the rotary shaft may be connected to a drive mechanism.

In another aspect of the present invention, a roots pump includes a stator. The stator has a cylinder wall and a pair of diaphragms disposed at opposing ends of the cylinder wall. A pair of rotary shafts passes through the diaphragms parallel to each other. A lobe having a fluid port is attached to the rotary shafts in the stator. The lobe includes a fluid port.

In some embodiments, the stator may include a first diaphragm, a second diaphragm parallel to the first diaphragm, and a third diaphragm parallel to the second diaphragm. The second diaphragm may be disposed between the first diaphragm and the third diaphragm. A first cylinder wall may surround a first pump chamber between the first diaphragm and the second diaphragm. A second cylinder wall may surround a second pump chamber between the second diaphragm and the third diaphragm.

In other embodiments, the cylinder wall may include a suction port and a discharge port. The discharge port of the first cylinder wall may be in communication with the suction port of the second cylinder wall.

In still other embodiments, the fluid port may be disposed at sidewalls of the lobe to face the diaphragms. The rotary shafts may include a fluid supply path in communication with the fluid port, and the fluid supply path may be disposed to pass through the rotary shafts.

In yet other embodiments, the rotary shaft may be connected to a fluid feeder. The fluid feeder may supply an inert gas or a cleaning solution into the fluid port through the fluid supply path.

Another aspect of the present invention is directed to an exhaust system employing a vacuum pump. The exhaust system includes a stator connected to one end of a process chamber. The stator includes a cylinder wall and a pair of diaphragms disposed at ends of the cylinder wall. A rotary shaft passes through the diaphragms. A fluid feeder is connected to one end of the rotary shaft, and a lobe including a fluid port is attached to the rotary shaft in the stator. The rotary shaft has a fluid supply path passing through the shaft and in communication with the fluid port.

In some embodiments, the cylinder wall may include a suction port and a discharge port. The suction port may be in communication with one end of the process chamber. The discharge port may be in communication with a scrubber.

In other embodiments, the fluid port may be disposed at sidewalls of the lobe facing the diaphragms.

In still other embodiments, the fluid feeder may supply an inert gas or a cleaning solution into the fluid port. The inert gas may be Nitrogen ($N_2$) gas at a predetermined temperature.

BRIEF DESCRIPTION OF THE DRAWINGS

The foregoing and other objects, features and advantages of the invention will become more apparent from the following description of exemplary embodiments of the invention and the accompanying drawings. The drawings are not necessarily to scale, emphasis instead being placed upon illustrating the principles of the invention.

DETAILED DESCRIPTION

Figure 1:
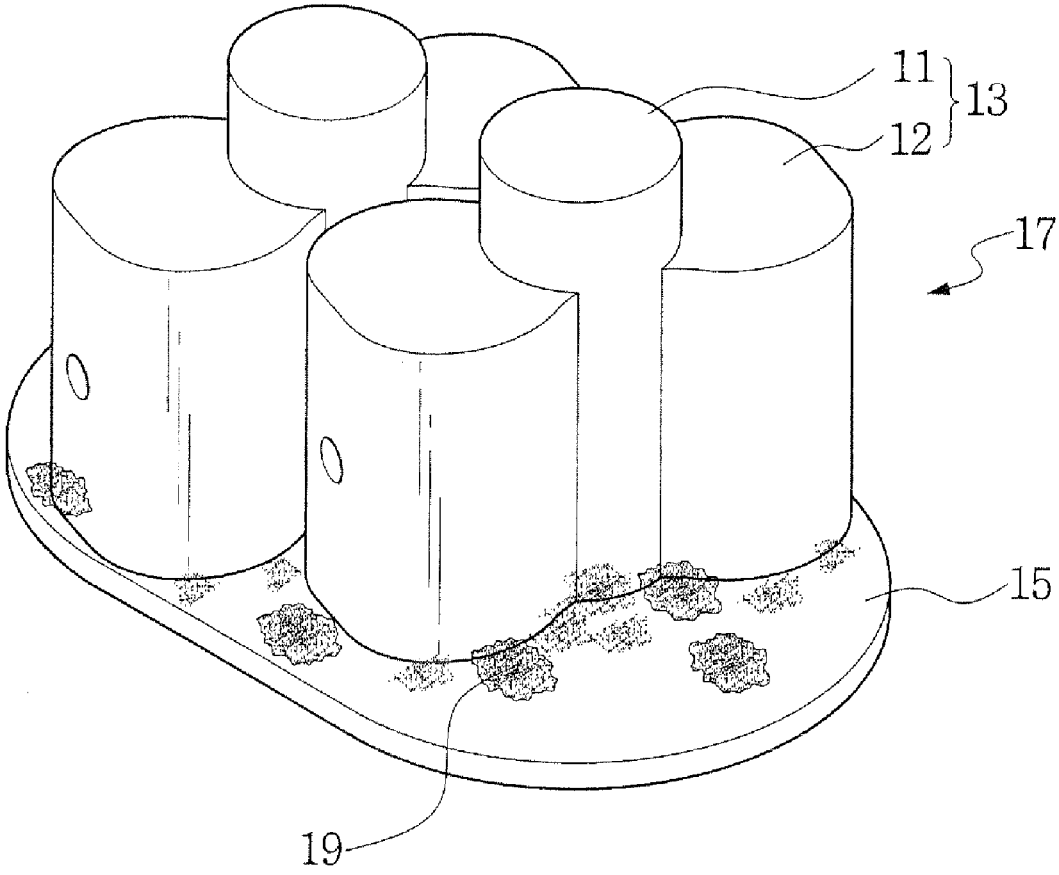
FIG. 1 (PRIOR ART)
FIG. 1 is a partial perspective view of a conventional roots pump.

The present invention will now be described more fully hereinafter with reference to the accompanying drawings, in which exemplary embodiments of the invention are shown. This invention may, however, be embodied in a variety of different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout the specification.

Figure 2:
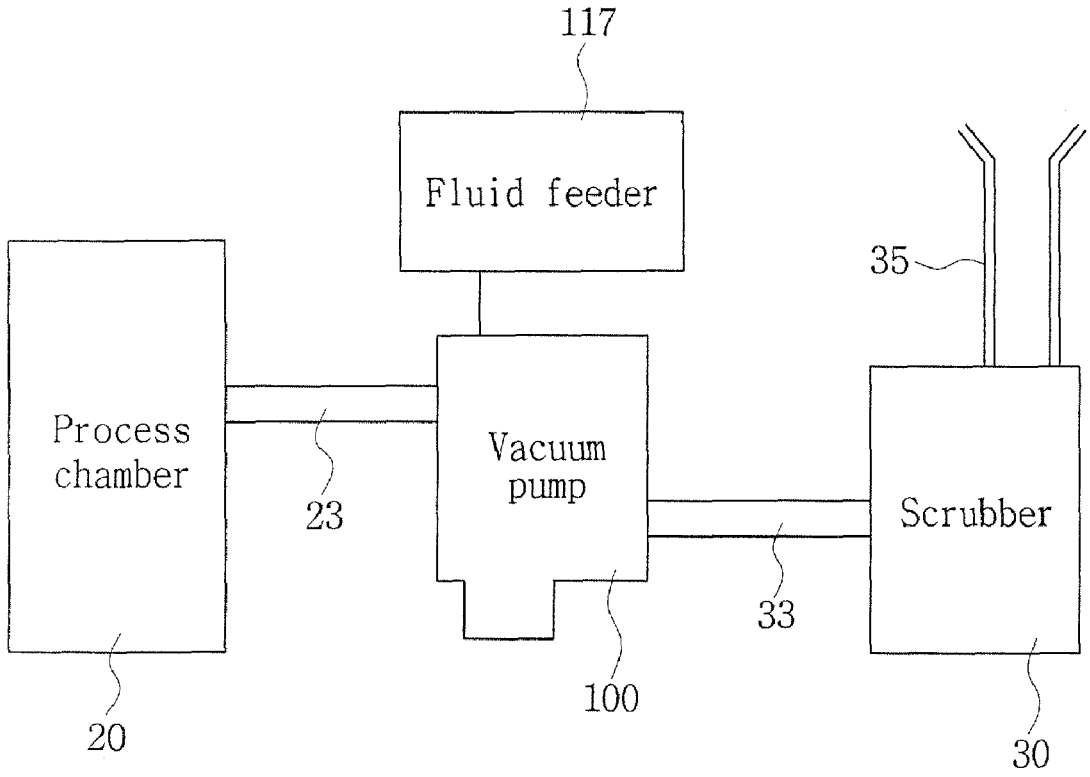
FIG. 2 is a schematic block diagram of an exhaust system having a vacuum pump in accordance with an exemplary embodiment.

FIG. 2 is a schematic block diagram of an apparatus having a vacuum pump in accordance with an exemplary embodiment. The apparatus may include a process chamber 20, and an exhaust system having a vacuum pump 100 and a scrubber 30 connected to the process chamber, and a fluid feeder 117 connected to the vacuum pump 100.

The process chamber 20 may, to list a few examples, be used in an annealing apparatus, a thin film deposition apparatus, or an etching apparatus for manufacturing a semiconductor device and/or a flat panel display. As is well-known in the art, the process chamber 20 may include process gas pipes (not shown) for injecting process gases, but their description will be omitted for the sake of convenience.

A first exhaust pipe 23 may connect the process chamber 20 to the vacuum pump 100. A second exhaust pipe 33 may connect the vacuum pump 100 to the scrubber 30. The first exhaust pipe 23 and the second exhaust pipe 33 may be formed of stainless steel, for example.

The vacuum pump 100 may convey by-products and residual gases in the process chamber 20 to the scrubber 30 through the first exhaust pipe 23 and the second exhaust pipe 33. That is, the vacuum pump 100 may discharge the by-products and the residual gases in the process chamber 20. In other embodiments, the vacuum pump 100 may be installed in the scrubber 30.

A third exhaust pipe 35 may be connected to the scrubber 30. The scrubber 30 may clean and separate the by-products and the residual gases, and then discharge them through the third exhaust pipe 35.

The vacuum pump 100 may be connected to a fluid feeder 117. The fluid feeder 117 may be an apparatus for supplying an inert gas or a cleaning solution. The inert gas may be Nitrogen ($N_2$) gas at a temperature in the range of 0 to 350° C., and the cleaning solution may be a strong volatile material, for example.

Even though the vacuum pump 100 may be a multistage roots pump, a screw pump, or a combination of these two types, the following embodiment includes a vacuum pump 100 being a multistage roots pump.

Figure 3:
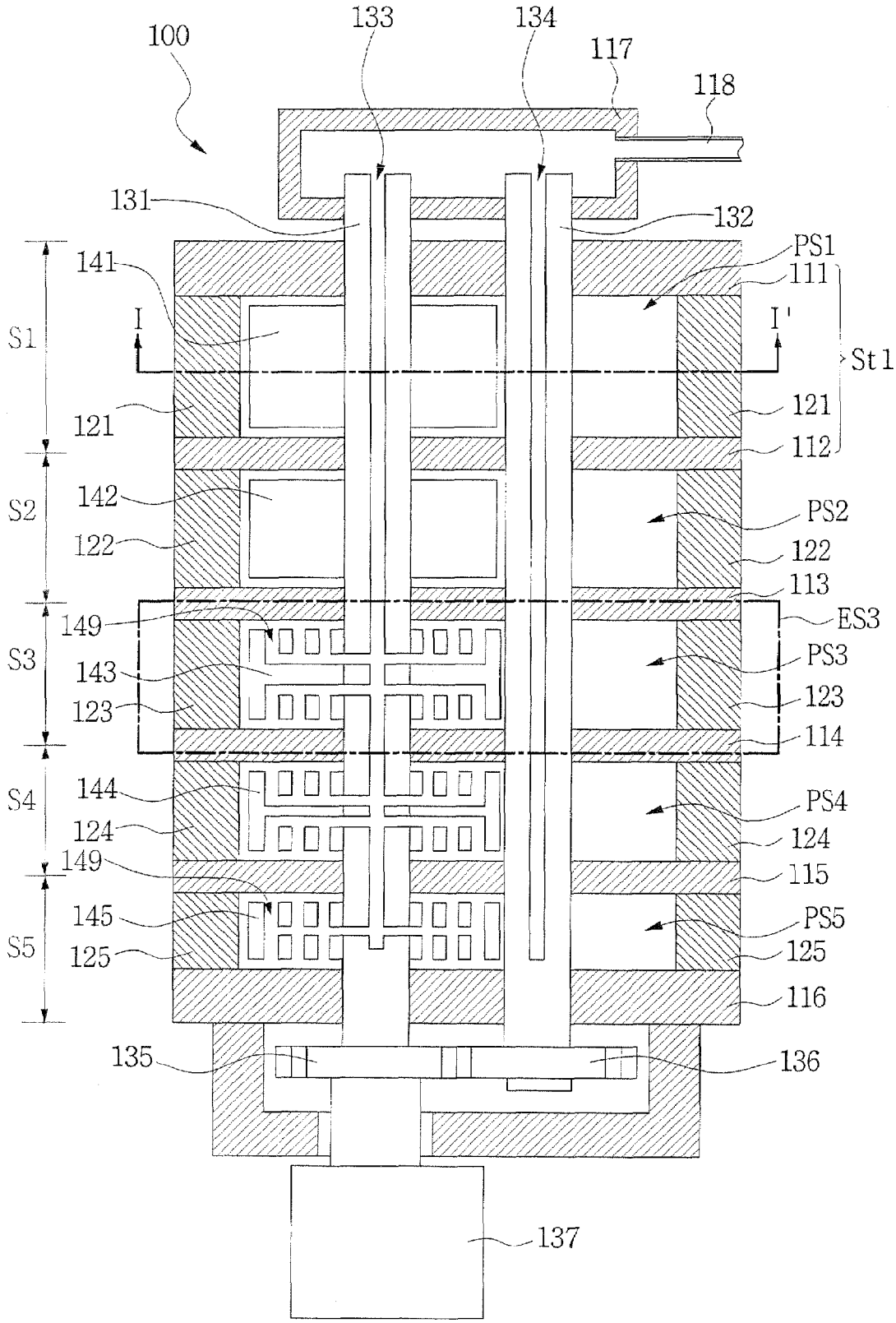
FIG. 3 is a cross-sectional side view of a multistage roots pump in accordance with another aspect of the invention.

FIG. 3 is a cross-sectional side view of a multistage roots pump 100 in accordance with an exemplary embodiment. Referring to FIG. 3, the multistage roots pump 100 may include first to fifth stages S1, S2, S3, S4, and S5. That is, a series of pumps are connected in a cascade fashion, so that the output of one stage is the input of the next stage, and so on.

The multistage roots pump 100 of the embodiment includes first to sixth diaphragms 111, 112, 113, 114, 115, and 116 disposed parallel to each other, in the order shown in FIG. 3.

First to fifth pump chambers PS1, PS2, PS3, PS4, and PS5 may be disposed among the first to sixth diaphragms 111, 112, 113, 114, 115, and 116. The first pump chamber PS1, which is disposed between the first diaphragm 111 and the second diaphragm 112, may be surrounded by a first cylinder wall 121. The second pump chamber PS2, which is disposed between the second diaphragm 112 and the third diaphragm 113, may be surrounded by a second cylinder wall 122, and so on for the remaining pump chambers PS3 to PS5.

The first to sixth diaphragms 111 to 116 and the first to fifth cylinder walls 121 to 125 may constitute stators St1 to St5, respectively. That is, the first cylinder wall 121, the first diaphragm 111, and the second diaphragm 112 may constitute a first stator St1, and so on.

Each of the first to fifth cylinder walls 121 to 125 may include a suction port (not shown) and a discharge port (not shown). The discharge port of the first cylinder wall 121 may be in communication with the suction port of the second cylinder wall 122. Similarly, the discharge port of the fourth cylinder wall 124 may be in communication with the suction port of the fifth cylinder wall 125, and so on. In this fashion, the suction port of the first cylinder wall 121 may be in communication with the discharge port of the fifth cylinder wall 125 via the discharge ports, the suction ports, and the first to fifth pump chambers PS1 to PS5.

In some embodiments, the first to fifth cylinder walls 121 to 125 may be integrally formed with each other. Hereinafter, as shown in FIG. 3, the multistage roots pump including the first to fifth cylinder walls 121 to 125, which are spaced apart from each other, will be described.

A first rotary shaft 131 passing through the first to sixth diaphragms 111 to 116 may be provided. A second rotary shaft 132 may be disposed parallel to the first rotary shaft 131. The second rotary shaft 132 may also pass through the first to sixth diaphragms 111 to 116. The first and second rotary shafts 131 and 132 may be hollow to carry a fluid, as described in detail below.

One end of the first rotary shaft 131 may be connected to a first gear 135, one end of the second rotary shaft 132 may be connected to a second gear 136, and the first gear 135 may be in contact with the second gear 136. The first rotary shaft 131 may be connected to a drive mechanism 137 such as a rotary motor through the first gear 135. The drive mechanism 137 may provide rotational power to the first rotary shaft 131. The second rotary shaft 132 may receive the rotational power from the drive mechanism 137 through the second gear 136 and the first gear 135. The first rotary shaft 131 and the second rotary shaft 132 may be rotated in opposite directions by the drive mechanism 137, and the first and second gears 135 and 136. These and other mechanical details are well-known in the art, and can be modified in other embodiments.

First lobes 141 may be mounted on the first and second rotary shafts 131 and 132 in the first pump chamber PS1. Specifically, a pair of the first lobes 141 opposite to each other may be mounted on the first rotary shaft 131 in the first pump chamber PS1. Similarly, a pair of the first lobes 141 opposite to each other may be mounted on the second rotary shaft 132 in the first pump chamber PS1. The first stator St1, the first lobes 141, the first rotary shaft 131, and the second rotary shaft 132 may constitute the first stage S1.

In addition, second to fifth lobes 142, 143, 144, and 145 may be mounted on the first and second rotary shafts 131 and 132 in the second to fifth pump chambers PS2, PS3, PS4, and PS5, respectively. The second to fifth stators, the second to fifth lobes 142, 143, 144, and 145, and the first and second rotary shafts 131 and 132 may constitute the second to fifth stages S2, S3, S4, and S5, respectively.

The third to fifth lobes 143, 144 and 145 may include fluid ports 149, but other embodiments may include any number of lobes that include fluid ports 149. The fluid ports 149 may be disposed at sidewalls of the third to fifth lobes 143, 144, and 145 opposite to the third to sixth diaphragms 113, 114, 115, and 116.

The first rotary shaft 131 and the second rotary shaft 132 may be connected to a fluid feeder 117, and the fluid feeder 117 may include a fluid pipe 118 for receiving fluid from an exterior source. The fluid feeder 117 may include an apparatus for supplying an inert gas or a cleaning solution. The inert gas may be Nitrogen ($N_2$) gas in a temperature range of 0-350° C., and the cleaning solution may be a strong volatile material.

A first fluid supply path 133 passing through the first rotary shaft 131 may be provided, and a second fluid supply path 134 passing through the second rotary shaft 132 may be provided. The first fluid supply path 133 and the second fluid supply path 134 may be in communication with the fluid port 149 and the fluid feeder 117, respectively.

Accordingly, the fluid feeder 117 can supply the inert gas or cleaning solution to the fluid port 149 via the first fluid supply path 133 and the second fluid supply path 134.

Figure 4:
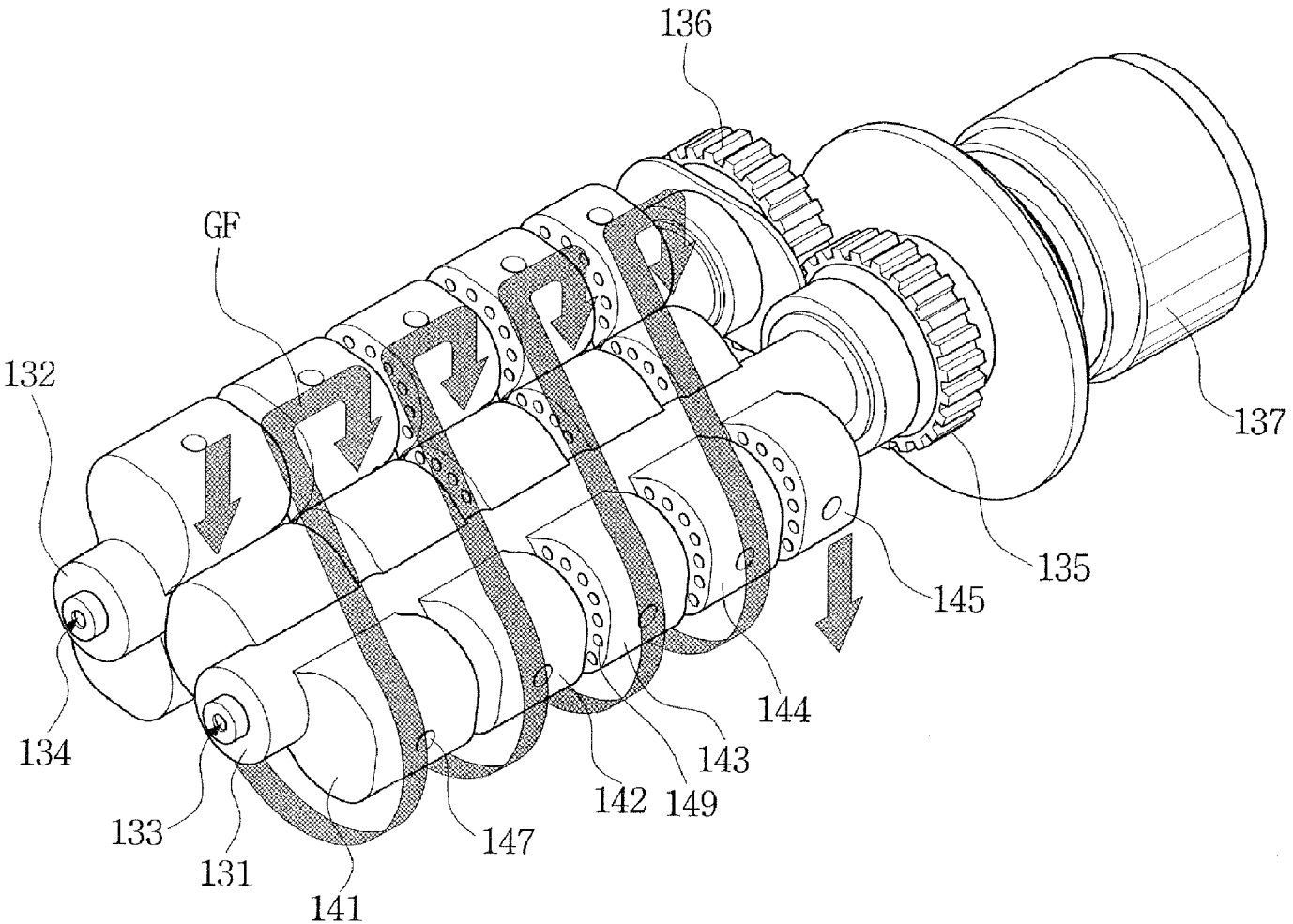
FIG. 4 is a perspective view of a rotor and a drive mechanism of FIG. 3, illustrating a multistage roots pump in accordance with yet another aspect of the invention.

FIG. 4 is a perspective view of the rotor and the drive mechanism of FIG. 3, illustrating the multistage roots pump in accordance with the present embodiment. Referring to FIG. 4, the first to fifth lobes 141 to 145 may be attached to the first rotary shaft 131 and the second rotary shaft 132 using bolts 147, for ease of assembly. But any number of attachment methods familiar to one skilled in the art may be used. The lobes 141 to 145 may be coupled with the rotary shafts 131 and 132 to form a rotor.

Defining length to be in the axial direction of the first rotary shaft 131 and the second rotary shaft 132, the second lobe 142 may have a smaller length than the first lobe 141 and the fifth lobe 145 may have a smaller length than the fourth lobe 144. That is, the first lobe 141 may have the longest length, and the fifth lobe 145 may have the shortest length. In addition, the third to fifth lobes 143, 144 and 145 may include the fluid ports 149. The fluid ports 149 may be disposed at sidewalls of the third to fifth lobes 143, 144 and 145 opposite to the third to sixth diaphragms 113, 114, 115 and 116.

The first fluid supply path 133 may pass through the first rotary shaft 131, and the second fluid supply path 134 may pass through the second rotary shaft 132. The fluid ports may be in communication with the first fluid supply path 133 or the second fluid supply path 134.

The first rotary shaft 131 and the second rotary shaft 132 may be connected to the first gear 135 and the second gear 136, respectively. The first gear 135 and the second gear 136 may mesh with each other in such a manner as to rotate the first rotary shaft 131 and the second rotary shaft 132 in opposite directions. The drive mechanism 137 may rotate the first rotary shaft 131 and the second rotary shaft 132 in opposite directions using the first gear 135 and the second gear 136.

As described with reference to FIG. 3, the first to fifth cylinder walls 121 to 125 may include a suction port and a discharge port, respectively. The suction port of the first cylinder wall 121 may be in communication with the discharge port of the fifth cylinder wall 125 via the discharge ports, the suction ports, and the first to fifth pump chambers PS1 to PS5.

As described with reference to FIG. 2, the process chamber 20 may be in communication with the suction port of the first cylinder wall 121 through the first exhaust pipe 23. In addition, the discharge port of the fifth cylinder wall 125 may be in communication with the scrubber 30 through the second exhaust pipe 33.

In this case, by-products and residual gases generated from the process chamber 20 may be sucked through the suction port of the first cylinder wall 121. The sucked by-products and residual gases may be transferred to the scrubber 30 through the discharge port of the fifth cylinder wall 125 via the first to fifth pump chambers PS1 to PS5. That is, a by-product discharge path GF shown as an arrow in FIG. 4 may be provided.

Figure 5:
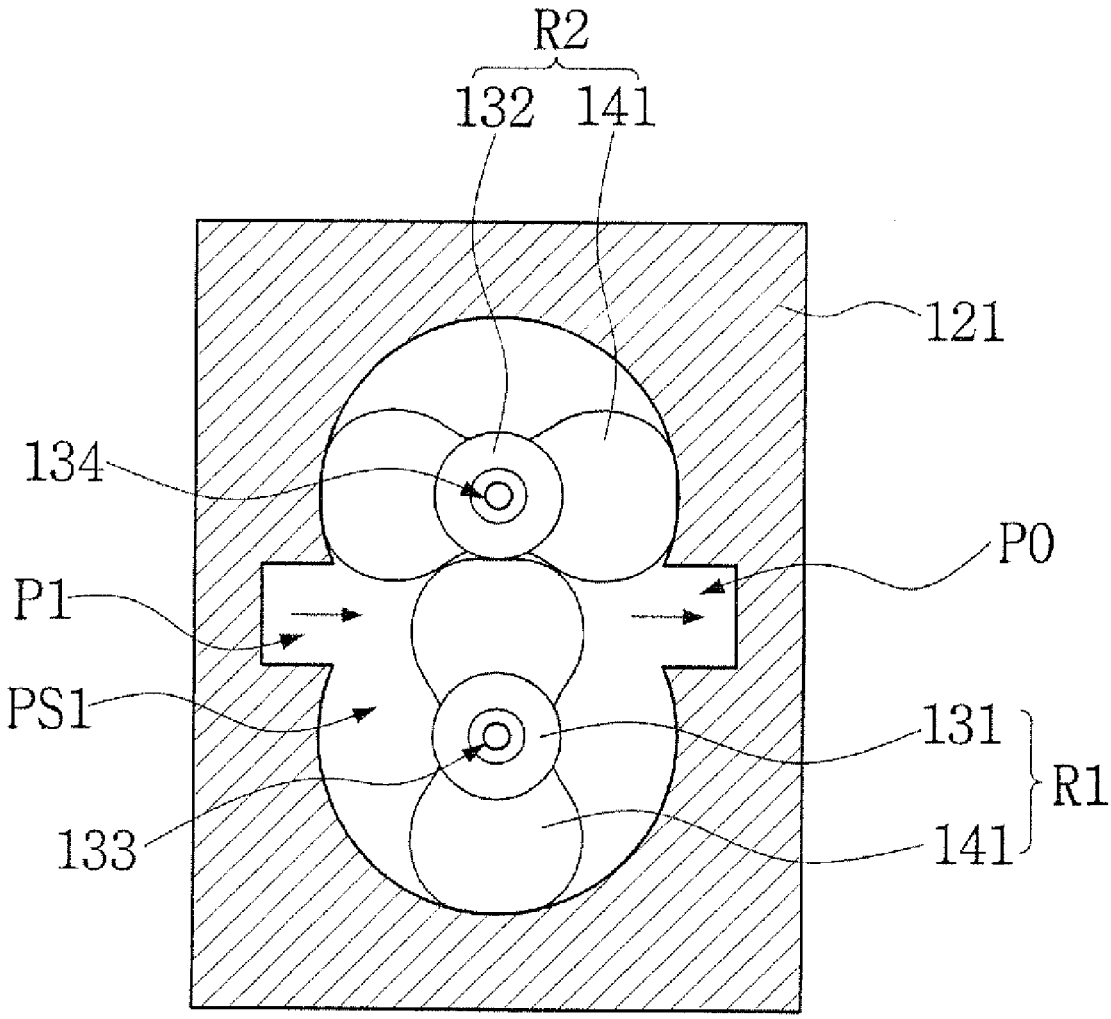
FIG. 5 is a cross-sectional view along line I-I' of FIG. 3.
Figure 6:
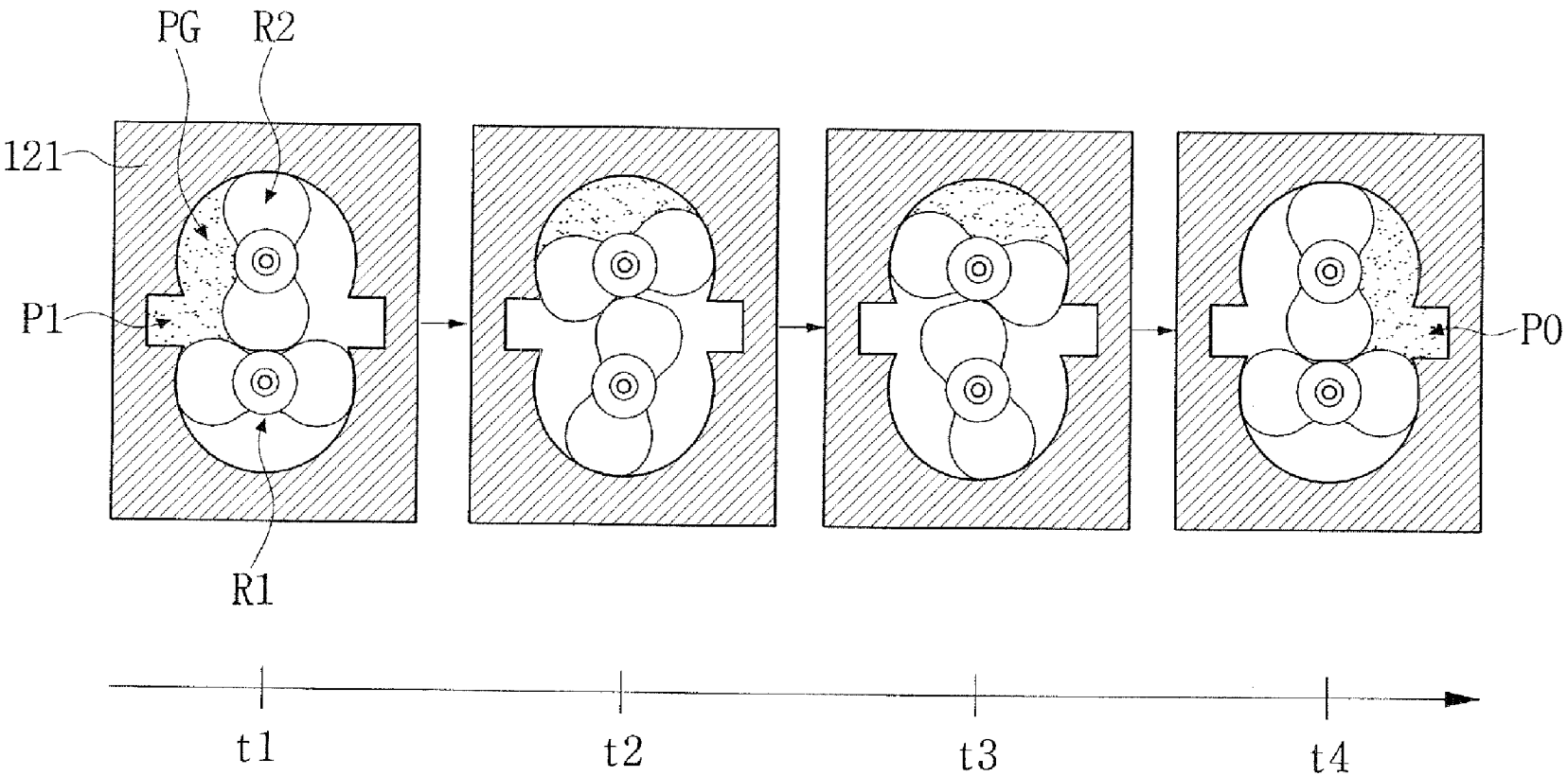
FIG. 6 schematically shows a sequence of operation of the multistage roots pump of FIG. 5.

FIGS. 5 and 6 are cross-sectional side views taken along line I-I' of FIG. 3, illustrating the operation of a multistage roots pump.

Referring to FIG. 5, the first lobes 141, the first rotary shaft 131, and the second rotary shaft 132 may be disposed in the first pump chamber PS1 in the first cylinder wall 121. A pair of the first lobes 141 may be mounted on the first rotary shaft 131 opposite to each other. The first rotary shaft 131 and the first lobes 141 may constitute a first rotor R1. Similarly, another pair of the first lobes 141 may be mounted opposite to each other on the second rotary shaft 132. The second rotary shaft 132 and the first lobes 141 may constitute a second rotor R2.

The suction port P1 may be disposed at one side of the first cylinder wall 121. The discharge port P0 may be disposed at another side of the first cylinder wall 121.

Referring to FIG. 6, the by-products PG may be introduced into the first pump chamber PS1 through the suction port P1 during a first period t1. Afterward, the by-products PG may be moved in the first pump chamber PS1 in a rotational direction of the first rotor R1 and the second rotor R2 during a second period t2 and a third period t3. Next, the by-products PG may be discharged through the discharge port P0 by the rotation of the first rotor R1 and the second rotor R2 during a fourth period t4.

Figure 7:
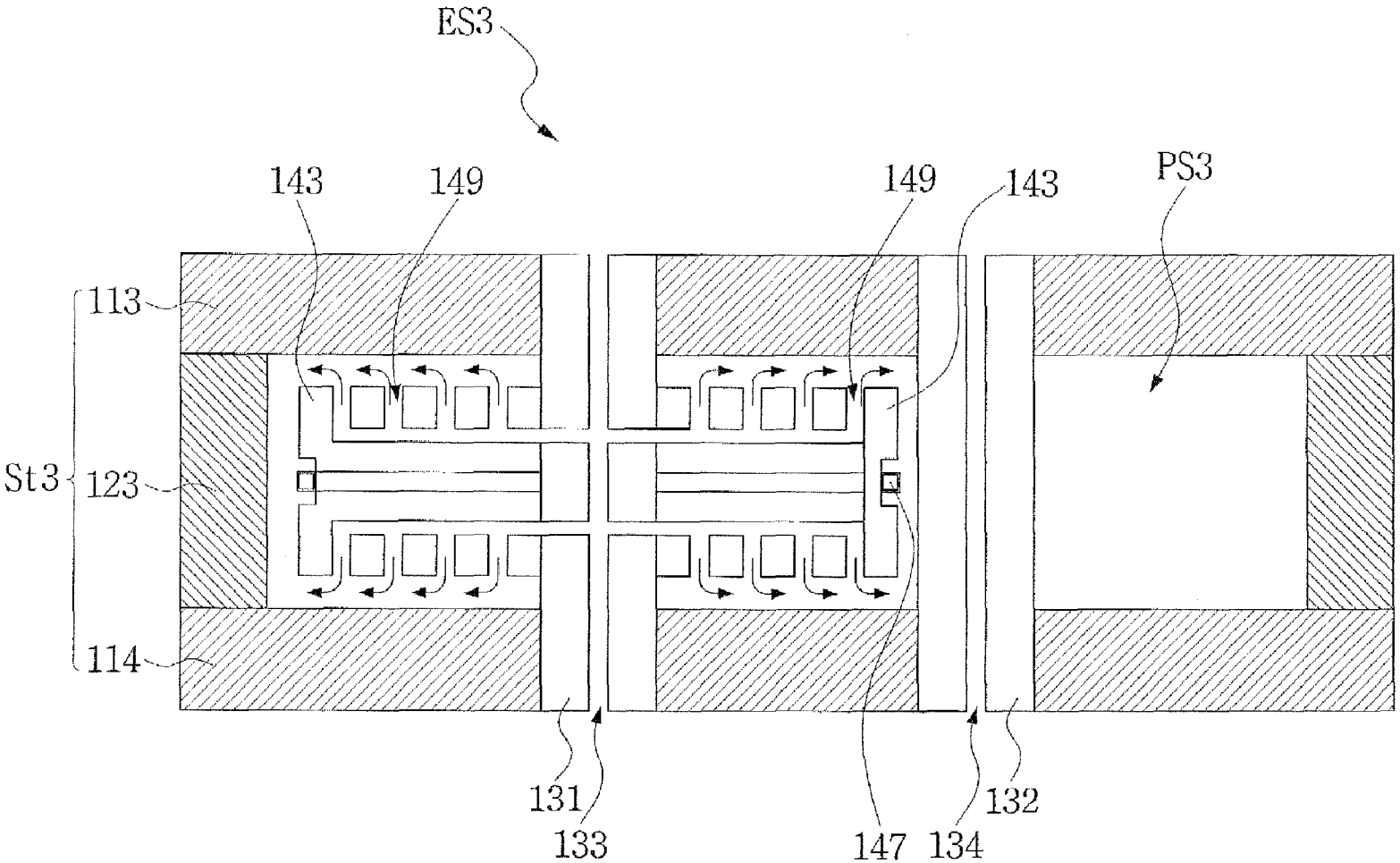
FIG. 7 is an enlarged cross-sectional view of region ES3 of FIG. 3.
Figure 8:
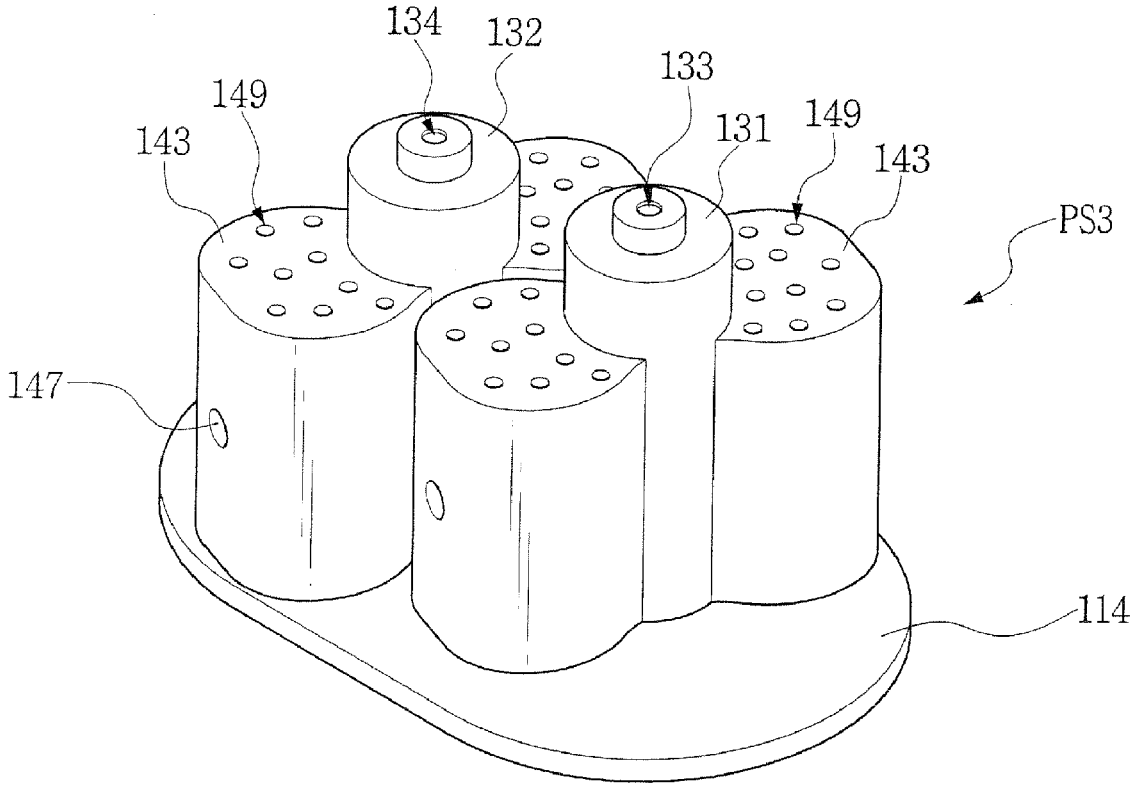
FIG. 8 is a perspective view showing the disposition of the diaphragm and the rotor of FIG. 7, including a view of the fluid ports disposed in the rotor.

FIG. 7 is an enlarged view of the third stage S3 roots pump denoted as ES3 in FIG. 3. FIG. 8 is a perspective view showing the disposition of a diaphragm and a rotor of FIG. 7. Also visible in this figure are the fluid ports 149.

Referring to FIGS. 7 and 8, the third cylinder wall 123 is disposed between the third diaphragm 113 and the fourth diaphragm 114. The third diaphragm 113 and the fourth diaphragm 114 may be disposed opposite and parallel to each other. The third cylinder wall 123, the third diaphragm 113, and the fourth diaphragm 114 may constitute the third stator St3, and the third pump chamber PS3 may be provided in the third stator St3.

The first rotary shaft 131 and the second rotary shaft 132 are parallel to each other and pass through the third diaphragm 113 and the fourth diaphragm 114. The first fluid supply path 133 passes through the first rotary shaft 131 and the second fluid supply path 134 passes through the second rotary shaft 132.

A pair of the third lobes 143 may be mounted on the first rotary shaft 131 opposite to each other. The third lobes 143 may be fixed to the first rotary shaft 131 using fixing means such as a bolt 147 or any other desired fixing means known in the art. Similarly, another pair of the third lobes 143 may also be mounted on the second rotary shaft 132. The rotary shafts 131 and 132 and the third lobes 143 may constitute the rotors.

The third lobes 143 may include the fluid ports 149. The fluid ports 149 may be disposed on sidewalls of the third lobes 143 to face the third diaphragm 113 and the fourth diaphragm 114. The fluid ports 149 may be disposed at predetermined intervals.

The fluid ports 149 may be in communication with the first fluid supply path 133. When the inert gas or the cleaning solution is supplied through the first fluid supply path 133, the fluid ports 149 may inject the inert gas or the cleaning solution into the third pump chamber PS3. In this case, a fluid film of the inert gas or the cleaning solution may be formed between the third lobes 143, along their sidewalls, and the third diaphragm 113 and between the third lobes 143 and the fourth diaphragm 114.

During an operation of the vacuum pump 100, the first rotary shaft 131 and the second rotary shaft 132 may be connected to the fluid feeder 117 that may supply the inert gas or the cleaning solution into the fluid ports 149 via the first fluid supply path 133 and the second fluid supply path 134. The inert gas may be Nitrogen ($N_2$) gas and the cleaning solution may be a strong volatile material. Both substances can be introduced into the vacuum pump 100 at any temperature that is most effective for cleaning the by-product masses 19.

The fluid ports 149 may be disposed at sidewalls of the third to fifth lobes 143, 144, and 145 facing the third to sixth diaphragms 113, 114, 115, and 116, respectively. Therefore, the inert gas or the cleaning solution may be injected into the third to fifth pump chambers PS3, PS4, and PS5 through the fluid ports 149. A fluid film of the inert gas or the cleaning solution may be formed between the sidewalls of the third to fifth lobes 143, 144 and 145, and the third to sixth diaphragms 113, 114, 115, and 116.

The first rotary shaft 131 and the second rotary shaft 132 may be rotated in opposite directions using the drive mechanism 137. In this case, by-products and residual gases generated from the process chamber 20 may be sucked through the suction port P1 of the first cylinder wall 121. Shown as the by-product discharge path GF of FIG. 4, the sucked by-products and residual gases may be transferred to the scrubber 30 through the discharge port of the fifth cylinder wall 125 via the first to fifth pump chambers PS1 to PS5.

The by-products and the residual gases may be gradually cooled while passing through the by-product discharge path GF. Generally, the by-products and the residual gases adhere to cooler surfaces at a temperature lower than a phase change temperature. For example, NH4Cl gas adheres at a temperature lower than 170° C. Eventually, adhesion of the by-products and the residual gases may continue in the sequence of the first pump chamber PS1 to the fifth pump chamber PS5.

A fluid film of the inert gas or the cleaning solution formed by the fluid ports 149 may prevent the by-products and the residual gases from adhering to the third to sixth diaphragms 113 to 116 and other internal surfaces of the pump chambers PS1 to PS5. In addition, it is possible to heat the inert gas or the cleaning solution to a higher temperature than the phase change temperature of the by-products, and then supply the inert gas or the cleaning solution. In this case, it is possible to effectively prevent adhesion of the by-products and the residual gases.

Figure 9:
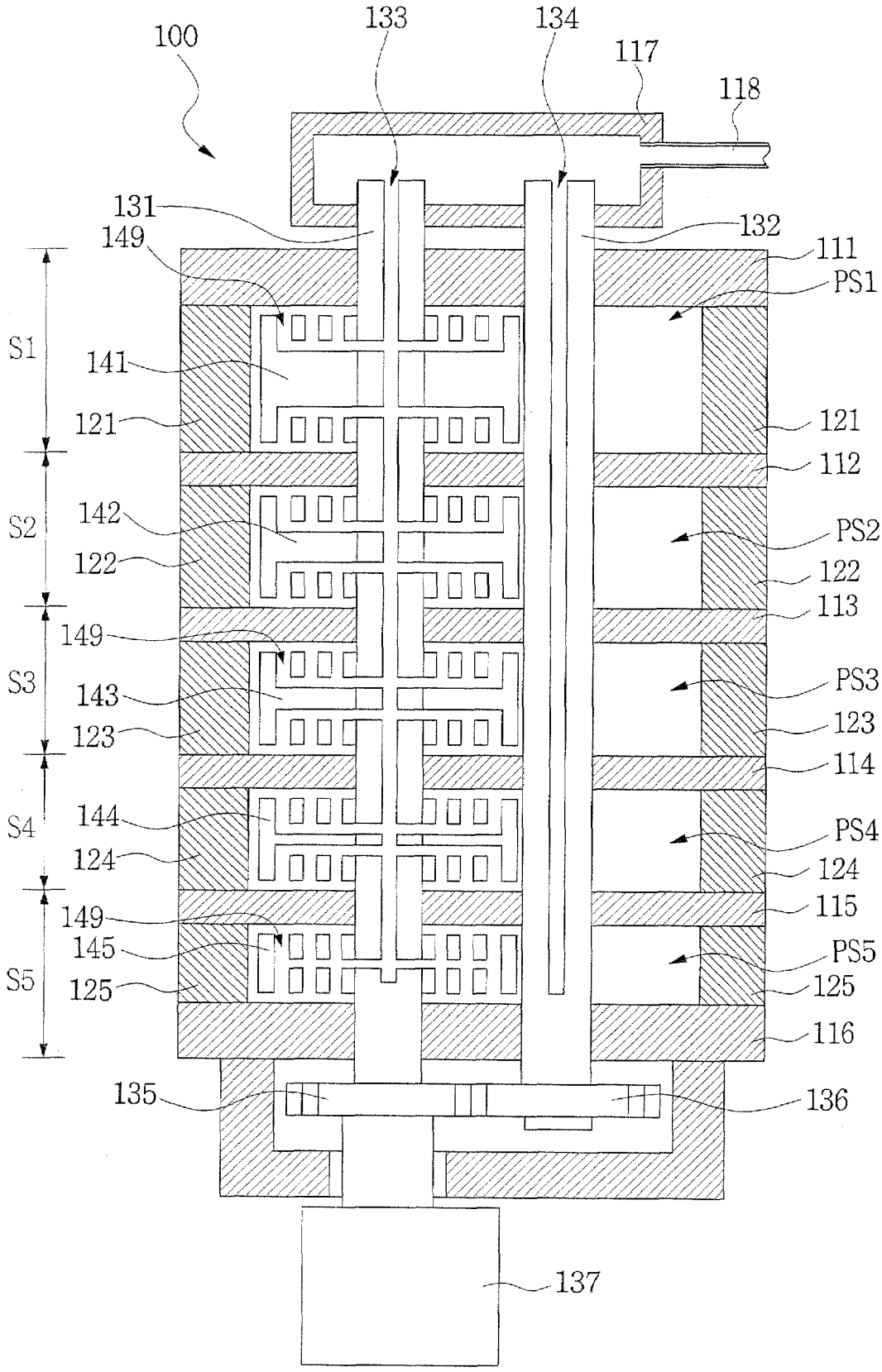
FIG. 9 is a cross-sectional side view of a multistage roots pump in accordance with another exemplary embodiment.

FIG. 9 is a cross-sectional view of a multistage roots pump in accordance with another exemplary embodiment. Referring to FIG. 9, in contrast to the previous embodiments, all of the first to fifth lobes 141, 142, 143, 144 and 145 include fluid ports 149. Other additional embodiments may include fluid ports 149 on a number of the first to fifth lobes 141 to 145 in any sequence. Also, as shown in the figures, each fluid port 149 is in the form of a nozzle directed towards an inner surface of a diaphragm, and each or a number of the lobes may have sets of such nozzles directed towards inner surfaces of the diaphragms. Additionally, the number of lobes and pump stages is not limited to five, as in the described embodiments.

The present invention may be modified into various shapes in the spirit of the present invention, and not be limited by the above embodiments. For example, the present invention may be adapted to a screw type vacuum pump and an exhaust system employing the same.

As can be seen from the foregoing, a multistage roots pump including a fluid port is provided at sidewalls of a lobe to face an adjacent diaphragm. The fluid port may be connected to a fluid feeder through a fluid supply path passing through a rotary shaft. The fluid feeder may supply an inert gas or a cleaning solution into the fluid port through the fluid supply path. The inert gas may be Nitrogen ($N_2$) gas. Therefore, a fluid film of the inert gas or the cleaning solution may be formed between the sidewalls of the lobe and the diaphragm. The fluid film of the inert gas or the cleaning solution formed by the fluid port may prevent adhesion of by-products and residual gases to the diaphragm.

Exemplary embodiments of the present invention have been disclosed herein and, although specific terms are employed, they are used and are to be interpreted in a generic and descriptive sense only and not for the purpose of limitation. Accordingly, it will be understood by those of ordinary skill in the art that various changes in form and details may be made without departing from the spirit and scope of the present invention as set forth in the following claims.

What is claimed is:

1. A vacuum pump comprising:

a stator including a cylinder wall, and a pair of diaphragms, the cylinder wall having opposite ends, and the diaphragms disposed at the ends of the cylinder wall, respectively, such that respective inner surfaces of the cylinder wall and diaphragms delimit a pump chamber of the stator;

a rotary shaft passing through the diaphragms, the rotary shaft having a passageway therein that extends into the pump chamber from outside the stator and defines a fluid supply path; and a lobe attached to the rotary shaft and extending radially outwardly therefrom in the pump chamber, wherein the lobe has side surfaces that face the diaphragms, respectively, the side surfaces of the lobe have at least one fluid port therein, each of said at least one fluid port confronts the inner surface of one of the diaphragms, and the at least one port is connected to the passageway so as to be in communication with the fluid supply path, whereby fluid fed along the fluid supply path discharges through each said at least one port towards the inner surface of one of the diaphragms.

2. The combination of a vacuum pump according to claim 1, and a fluid supply system that supplies an inert gas or a cleaning solution, wherein the fluid supply system comprises a fluid feeder having an outlet connected to the passageway of the rotary shaft of the vacuum pump such that the inert gas or cleaning solution fed by the fluid feeder will flow through the fluid supply path.

3. The combination according to claim 2, wherein the fluid supply system supplies inert gas and comprises, for the fluid supply path, a supply of Nitrogen ($N_2$) gas at a temperature in the range of 0-350° C.

4. The vacuum pump according to claim 1, wherein the cylinder wall includes a suction port and a discharge port.

5. The vacuum pump according to claim 1, further comprising a drive mechanism connected to the rotary shaft.

6. The vacuum pump according to claim 1, wherein the at least one fluid port comprises several nozzles directed towards one of the diaphragms.

7. The vacuum pump according to claim 1, wherein the at least one fluid port comprises several nozzles directed towards one of the diaphragms, and several nozzles directed towards the other one of the diaphragms.

8. A roots pump comprising:

a stator including a cylinder wall, and a pair of diaphragms, the cylinder wall having opposite ends, and the diaphragms disposed at the ends of the cylinder wall, respectively, such that respective inner surfaces of the cylinder wall and diaphragms delimit a pump chamber of the stator;

a pair of rotary shafts, the rotary shafts passing through the diaphragms and disposed parallel to each other, and having a passageway therein that extends into the pump chamber from outside the stator and defines a fluid supply path; and lobes attached to and extending radially outwardly from the rotary shafts, respectively, in the pump chamber, wherein the lobes each have side surfaces that face the diaphragms, respectively, the side surfaces of the lobes have at least one fluid port therein, each of said at least one fluid port confronts the inner surface of one of the diaphragms, and the at least one port is connected to the passageway so as to be in communication with the fluid supply path, whereby fluid fed along the fluid supply path discharges through each said at least one port towards the inner surface of one of the diaphragms.

9. The roots pump according to claim 8, wherein the stator comprises:

a first diaphragm;

a second diaphragm parallel to the first diaphragm;

a third diaphragm parallel to the second diaphragm;

a first cylinder wall surrounding a first pump chamber between the first diaphragm and the second diaphragm; and a second cylinder wall surrounding a second pump chamber between the second diaphragm and the third diaphragm, the second diaphragm being disposed between the first diaphragm and the third diaphragm.

10. The roots pump according to claim 9, wherein a respective pair of the lobes is disposed in each of the pump chambers, the lobes of each pair are attached to and extend radially outwardly from the rotary shafts, respectively, the lobes each have side surfaces that respectively face the diaphragms located on opposite ends of the pump chamber in which the lobe extends, one of the first and second pump chambers does not have a fluid port in the side surfaces of the lobes, and the other one of the first and second pump chambers has the at least one fluid port in the side surface of the lobes that is connected to the passageway.

11. The roots pump according to claim 9, wherein each of the cylinder walls comprises a suction port and a discharge port, the discharge port of the first cylinder wall being in communication with the suction port of the second cylinder wall.

12. The roots pump according to claim 8, wherein the rotary shafts each include a passageway therein that defines a fluid supply path, and the side surfaces of each of the lobes have at least one fluid port therein connected to the passageway in the rotary shaft from which the lobe extends in the pump chamber.

13. The combination of a roots pump according to claim 12 and a fluid supply system that supplies an inert gas or a cleaning fluid, wherein the fluid supply system comprises a fluid feeder having an outlet connected to the rotary shafts such that the inert gas or cleaning solution fed by the fluid feeder will flow through the fluid supply path.

14. The combination according to claim 13, wherein the fluid supply system supplies inert gas and comprises, for the fluid supply path, a supply of Nitrogen ($N_2$) gas at a temperature in the range of 0-350° C.

15. The combination of a process chamber and an exhaust system connected to the process chamber, wherein the exhaust system comprises:

a stator including a cylinder wall, and a pair of diaphragms, the cylinder wall having opposite ends, and the diaphragms disposed at the ends of the cylinder wall, respectively, such that respective inner surfaces of the cylinder wall and diaphragms delimit a pump chamber of the stator, said stator being connected to the process chamber such that the pump chamber is in communication with the process chamber;

a rotary shaft passing through the diaphragms;

a fluid supply system comprising a fluid feeder having an outlet connected to one end of a passageway in the rotary shaft such that fluid fed by the fluid feeder will flow through the fluid supply path; and a lobe attached to the rotary shaft and extending radially outwardly therefrom in the stator including a pump chamber, wherein the lobe has side surfaces that face the diaphragms, respectively, the side surfaces of the lobe have at least one fluid port therein, each of said at least one fluid port confronts the inner surface of one of the diaphragms, and the passageway of the rotary shaft extends into the pump chamber from outside the stator and defines a fluid supply path in communication with the at least one fluid port and the outlet of the fluid feeder whereby fluid fed from the fluid feeder will flow along the fluid supply path and be discharged through each of said at least one port towards the inner surface of one of the diaphragms.

16. The combination according to claim 15, wherein the cylinder wall comprises a suction port and a discharge port, the suction port being in communication with one end of the process chamber.

17. The combination according to claim 16, wherein the exhaust system further comprises a scrubber in communication with the discharge port.

18. The combination according to claim 15, wherein the fluid supply system supplies an inert gas or a cleaning solution.

19. The combination according to claim 18, wherein the fluid supply system supplies inert gas and comprises, for the fluid supply path, a supply of Nitrogen ($N_2$) gas at a temperature in the range of 0-350° C.

* * * * *